US005522763A

United States Patent [19]

Regnier

[11] Patent Number: 5,522,763

[45] Date of Patent: Jun. 4, 1996

[54] SANDING BLOCK

[76] Inventor: Jon O. Regnier, 4925 W. Roberts Dr., Santa Ana, Calif. 92704

[21] Appl. No.: 81,240

[22] Filed: Jun. 25, 1993

[51] Int. Cl.[6] ..... B24D 15/04

[52] U.S. Cl. ..... 451/502; 451/523

[58] Field of Search ..... 51/370, 371, 364, 51/391; 451/502, 503, 496, 523

[56] References Cited

U.S. PATENT DOCUMENTS

| | | | |
|---|---|---|---|
| 547,925 | 10/1895 | Keuffel | 51/364 |
| 2,103,320 | 12/1937 | Corff | 51/371 |
| 2,396,418 | 3/1946 | Grenzow | 51/370 |
| 2,595,429 | 5/1952 | Trussell | 51/391 |
| 3,063,208 | 11/1962 | Bell et al. | 51/391 |
| 4,501,096 | 2/1985 | Lukianoff | 51/370 |
| 5,177,909 | 1/1993 | Klocke | 51/370 |

FOREIGN PATENT DOCUMENTS

| | | | |
|---|---|---|---|
| 0133046 | 12/1901 | Germany | 51/370 |

*Primary Examiner*—Robert A. Rose
*Attorney, Agent, or Firm*—Edgar W. Averill, Jr.

[57] ABSTRACT

A sanding block having a generally rectangular block with a top, a bottom, a front side, a back side, a right side and a left side. An elongated kerf, is formed along the entire length of either the front side or the back side and the kerf has an accurately positioned bottom. One end of the block is tapered and the block is used by forming six folds in a standard 9"×11" piece of sand paper which can then be slid over the block, secured in the kerf and used as a sanding block.

6 Claims, 2 Drawing Sheets

SANDING BLOCK

BACKGROUND OF THE INVENTION

The field of the invention is woodworking tools and the invention relates more particularly to sanding blocks. Sanding blocks have been used for many years and numerous designs are available for holding a sheet of sandpaper. Such sanding blocks are imperfect, however, and either require the user to cut a standard 9"×11" sheet of sandpaper before inserting a portion in the block or are otherwise deficient. A sanding block on which the sandpaper can easily be inserted is shown in the Grenzow patent no. 2,396,418. In this patent, an elongated block, has a kerf 6 formed on an angle less than a right angle with respect to the side in which the sandpaper is placed. This approach provides one sanding surface which has a slot along it which can potentially cause some rough spots in the sandpaper at the line along which the sandpaper is bent. Another block is shown in the Trussell patent no. 2,911,769 which shows a sanding block somewhat similar to applicant's design in FIG. 5, but does not teach a simple way of securely placing the sandpaper on the block. Another sanding block is shown in Trussell U.S. Pat. No. 2,595,429 which utilizes a block which is a hollow channel member and the sandpaper is cut in a rather elaborate pattern and folded over the channel member.

The Botimer patent 3,975,868 shows a tapered sanding block which cooperates with a piece of sandpaper which has been folded on a slight angle and which is inserted over one end of the sanding block and tightens as the paper is further slid onto the block.

Lastly, the Lukianoff sanding block U.S. Pat. No. 4,640,060 shows a block which has two flat sides and an arcuate side which includes a kerf. The sandpaper is inserted with its opposing side in the kerf.

None of these sanding blocks are without shortcomings. For some of the designs, the sandpaper must be folded in an unusual pattern, several others call for the sandpaper to be pushed into a slot but show no way of facilitating the placing of the sandpaper into to the slot.

SUMMARY OF THE INVENTION

The present invention is for a sanding block and a process for using the same. The sanding block is made from a generally rectangular block, having a top, a bottom, a front side, a back side, a fight side and a left side. And an elongated kerf is formed along the entire length of either the front side or the back side and the kerf has an accurately placed kerf bottom. The kerf is parallel to the top and bottom of the sanding block. A tapered end portion facilitates sliding a folded rectangle of sandpaper onto the block in a secure and tight manner. Preferably the block and the kerf are formed of a size so that a standard 9"×11" sandpaper can be inserted thereon. The process of using the block of the present invention includes the step of inserting one edge of the sandpaper into the kerf until the edge touches the bottom of the kerf. The sandpaper is then folded around the sanding block forming a fight angle bend at the kerf, at the intersection between the side and the top, at the intersection between the top and the opposite side from the kerf, at the intersection between that side and the bottom, and between the intersection between the bottom and the side in which the kerf was formed. Then the sandpaper is removed and the second opposing edge is placed into the kerf and a right angle bend is formed between the kerf and the side in which the kerf is formed. Then the sandpaper square with the six fight angle bends in it, is slid on over the tapered end of the sanding block to form a tightly covered sanding block.

DESCRIPTION OF THE PREFERRED EMBODIMENT

Figure 1:
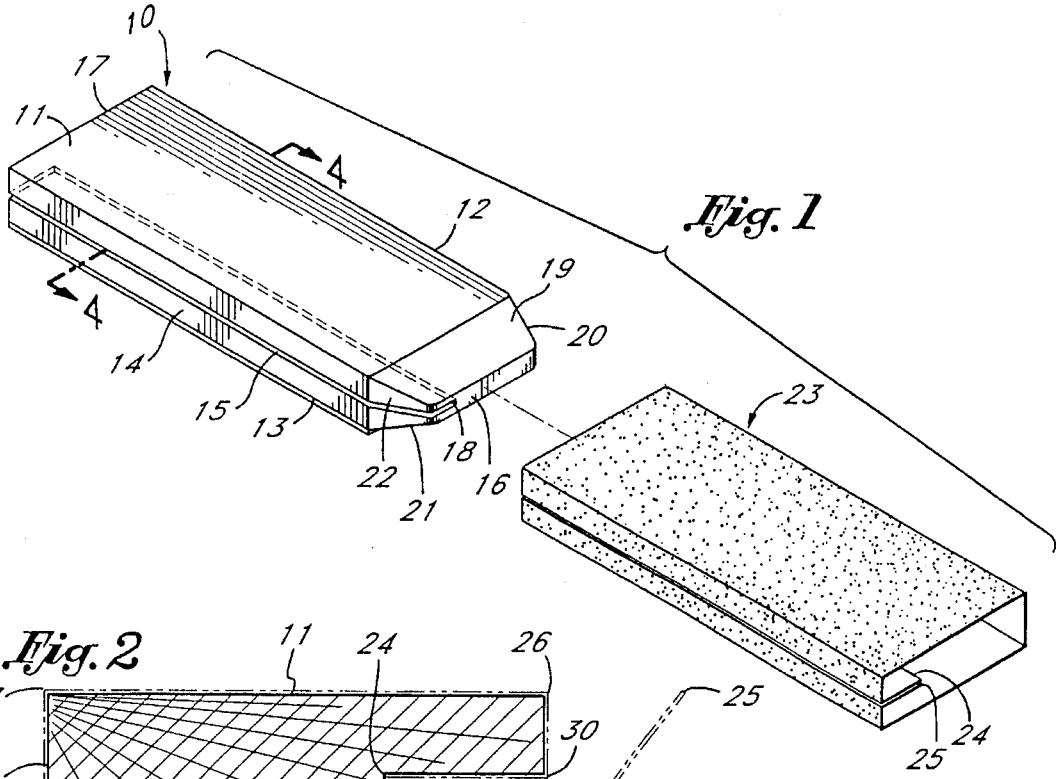
FIG. 1 is an exploded perspective view of the sanding block and a piece of folded sandpaper of the present invention.

A sanding block is shown in FIG. 1 and indicated generally by reference character 10. Block 10 has a top 11, a back side 12, a bottom 13, and a front side 14. An elongated kerf 15 is formed along the entire front side 14. The kerf extends from the right side 16 to the left side 17, and has a kerf 'bottom 18. Four tapered portions 19, 20, 21, and 22 are formed in the right side to facilitate placing the folded sandpaper 23 over sanding block 10.

Figure 2:
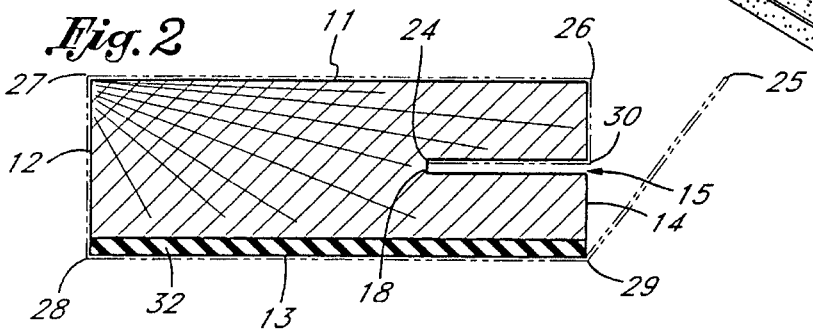
FIG. 2 is a Cross sectional view showing the sandpaper folded with five folds.
Figure 3:
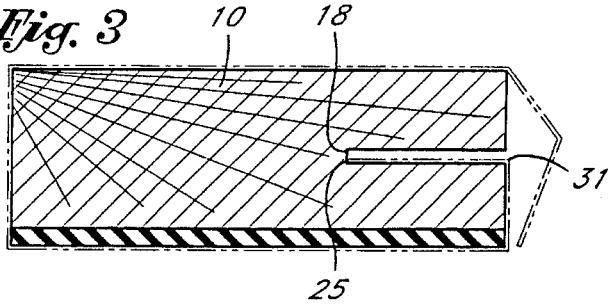
FIG. 3 shows-the sandpaper of FIG. 2 including a sixth fold.

The fully folded sandpaper 23 is folded in the manner shown in FIGS. 2 and 3. The sandpaper is originally a conventional 9"×11" rectangle and has opposing edges 24 and 25 as shown in phantom view in FIG. 2. Opposing edge 24 is inserted all the way into kerf 15 until it abuts the bottom 18 of the kerf. Then a fold 30 is formed in the sandpaper between the edge of the kerf and the front side 14. A second fold 26 is formed between front side 14 and top 11. A third fold 27 is formed between top 11 and back side 12. A fourth fold 28 is formed between back side 12 and bottom 13 and a fifth fold 29 is formed between bottom 13 and front side 14.

The partially folded sandpaper is then removed from the sanding block and the second opposing edge 25 is inserted to the bottom 18 of kerf 15 as shown in FIG. 3. A fold is then formed at 31 between front side 14 and kerf 15. This is the sixth and final fold which provides the fully folded sandpaper rectangle shown in FIG. 1.

Figure 4:
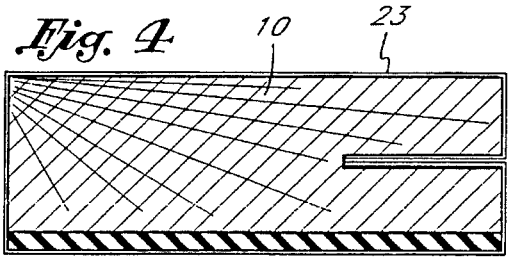
FIG. 4 is a cross sectional view along line 2—2 of FIG. 1 after the folded sandpaper shown in FIG. 1 has been slid onto the sanding block.

This fully folded sandpaper rectangle 23 may be easily slid over the tapered end of sanding block 10 as shown in FIG. 4. The sandpaper is smoothly and securely placed on the block and the folds are maintained along one of the sides and are not in the middle of one of the large flat sanding surfaces comprising either the top 11 or the bottom 13 of sanding block 10. A rubber pad 32 may be placed along one or both of the sanding block surfaces which is commonly used in sanding blocks.

Figure 5:
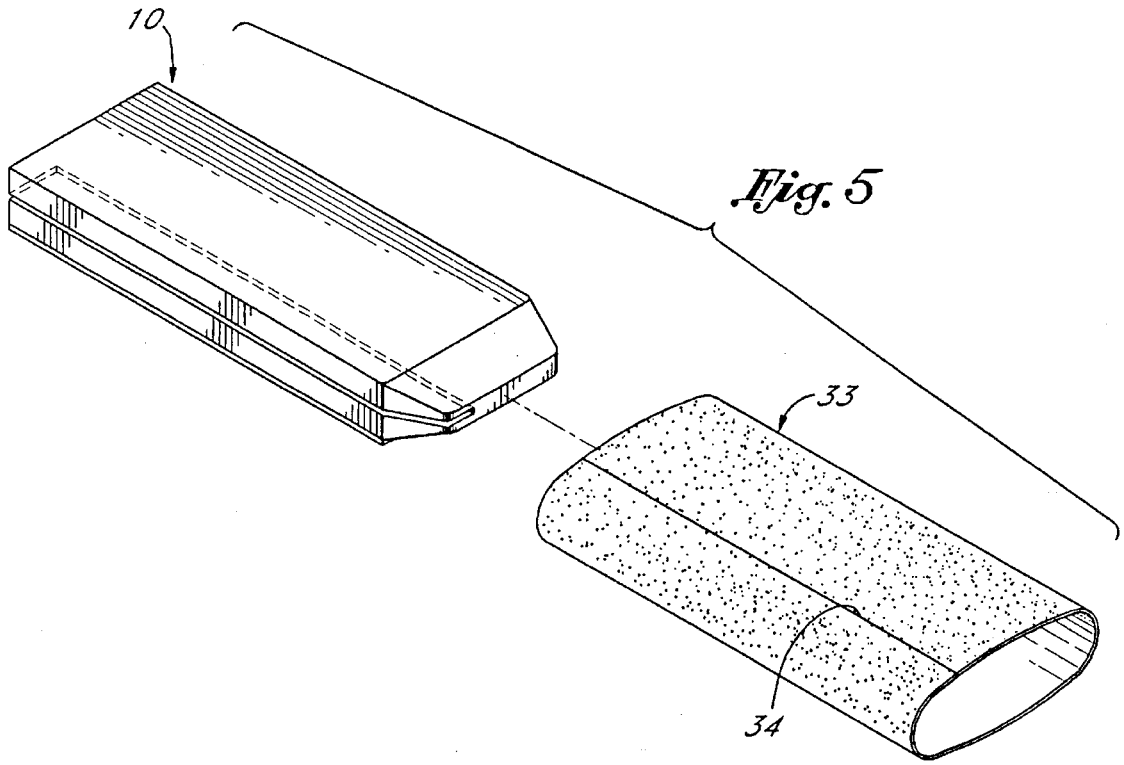
FIG. 5 is an exploded perspective view of the sanding block of FIG. 1 and a tube of sandpaper.

As shown in FIG. 5, the tapered end of block 10 is also useful for simply inserting a tube of sandpaper 33 over the block without using the kerf. The tube 33 is formed by taping or otherwise joining a rectangular sheet at joint 34.

The sanding block of the present invention may be fabricated from wood or plastic or other material. It is relatively inexpensive to fabricate and is preferably sized for a conventional 9"×11" rectangle of sandpaper. Thus, in use, a sheet of sandpaper is removed from the package and inserted as shown in FIG. 2. Then removed and inserted as shown in FIG. 3 and lastly inserted as shown in FIG. 1. The block can be formed with a kerf which is wide enough to take a wide range of sandpaper grits because of the propensity of sandpaper to form a sharp cornered fold,, the sandpaper regularly conforms to the shape shown in FIG. 1 and is remarkably easy to place onto block 10. The depth of the kerf is, of course, an important part of the present invention, permitting the kerf to be used to measure both of the folds between the kerf and the front side 14.

It is important that the kerf be formed at an angle which is about parallel to the top and bottom so that the sandpaper may be inserted either way onto the block and preferably the kerf is at the midpoint of front side 14.

While a rectangular piece of sandpaper has been shown in FIGS. 1, 2, 3, and 4, it is also possible to use the sanding block of the present invention with a tube of sandpaper such as that indicated by reference character 33 in FIG. 5. A joint 34 is sealed with tape or otherwise sealed and the size of the tube is such that it fits tightly around block 10. The tapered end of the block permits the easy installation of sandpaper tube 33 over block 10.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

what is claimed is:

1. A sanding block comprising:

a generally rectangular block having a top, a bottom, a front side, a back side, a right side and a left side;

an elongated kerf along the entire length of one of said front side and said back side, said kerf having a kerf bottom and said kerf being parallel to said top and bottom of said rectangular block;

a tapered end portion at the right side of said generally rectangular block including a taper in the top, front side, bottom and back side whereby a folded rectangle of sandpaper may be easily slipped over the tapered end portion to provide a sandpaper covered sanding block; and a generally rectangular sheet of sandpaper mounted on said generally rectangular block, said sheet of sandpaper having a top, a bottom, a right edge, a left edge, an abrasive surface and a smooth surface, said smooth surface being adjacent said block and said right and left edges being positioned adjacent the kerf bottom.

2. The sanding block of claim 1 wherein the depth of said kerf and the top, front side, bottom and back side are formed so that a standard nine inch by eleven inch sheet of sandpaper will tightly surround said rectangular block when two opposite edges of said sandpaper are placed in said kerf and the opposite edges abut the kerf bottom.

3. The sanding block of claim 2 wherein the kerf bisects the said front side into two equal portions.

4. The sanding block of claim 2 further including a resilient sheet on the bottom surface.

5. A process of fitting a standard rectangular sheet of sandpaper having an abrasive side and a paper side onto a sanding block of the type having a top, a bottom, a front side, a back side, a right side and a left side, an elongated kerf along the entire length of said front side, said kerf having a kerf bottom and a tapered end portion at the right side including a taper in the top, front side, bottom and back side, said standard sheet of sandpaper having first and second opposing edges, said process comprising the steps of:

inserting the first opposing edge of said sheet of sandpaper into said elongated kerf until said first opposing edge contacts the kerf bottom;

folding said sheet of sandpaper against that portion of said front side adjacent said top;

further folding said sheet of sandpaper around said top, back side and front side thereby forming a partially folded sandpaper sheet having five right angle creases;

removing said partially folded sandpaper sheet from said sanding block;

inserting the second opposing edge of said sheet of sandpaper into said elongated kerf until said second opposing edge contacts the kerf bottom;

folding said sheet of sandpaper in a direction which causes said abrasive side to be exposed over a portion of said front side to provide a completely folded sandpaper sheet;

removing said completely folded sandpaper sheet from said sanding block; and sliding the completely folded sandpaper sheet over the tapered end portion so that the first and second opposing edges of said completely folded sheet abut the bottom of said kerf and pushing the completely folded sandpaper sheet over the sanding block.

6. A sanding block comprising;

a generally rectangular block having a top, a bottom, a front side, a back side, a right side, and a left side;

a tapered end portion at the right side of said generally rectangular block including a taper in the top, front side, bottom and back side, whereby a tubular length of sandpaper may be easily slipped over the tapered end portion to provide a sandpaper covered sanding block; and a rectangular tube of sandpaper having a first end, a second end, a smooth inner surface and an abrasive exterior surface positioned so that its smooth inner surface is adjacent and in contact with the top, bottom, front and back of said rectangular block.

* * * * *